US006371726B1

(12) United States Patent
Jonsson et al.

(10) Patent No.: US 6,371,726 B1
(45) Date of Patent: Apr. 16, 2002

(54) FOLDABLE PROPELLER

(75) Inventors: Christer Jonsson, Göteborg; Bror Gustavsson, Lödöse, both of (SE)

(73) Assignee: AB Volvo Penta, Göteborg (SE)

( * ) Notice: Subject to any disclaimer, the term of this patent is extended or adjusted under 35 U.S.C. 154(b) by 0 days.

(21) Appl. No.: 09/676,858

(22) Filed: Oct. 2, 2000

Related U.S. Application Data

(63) Continuation of application No. 09/085,800, filed on May 27, 1998, now abandoned, which is a continuation of application No. PCT/SE96/01552, filed on Nov. 27, 1996.

(30) Foreign Application Priority Data

Nov. 28, 1995 (SE) ..... 9504253

(51) Int. Cl.[7] ..... B63H 1/24

(52) U.S. Cl. ..... 416/131; 416/142; 416/238; 416/241 R; 416/DIG. 2; 416/DIG. 5

(58) Field of Search ..... 416/87, 88, 131, 416/132 R, 140, 142, 223 R, 228, 238, 243, DIG. 2, DIG. 5, 241 R; 440/49, 50

(56) References Cited

U.S. PATENT DOCUMENTS 4,306,839 A * 12/1981 Pien ..... 416/238
4,331,429 A * 5/1982 Koepsel et al. ..... 440/49
4,609,827 A * 9/1986 Nepple ..... 416/119
4,789,306 A * 12/1988 Vorus et al. ..... 416/223 R

FOREIGN PATENT DOCUMENTS

| | | | |
|---|---|---|---|
| GB | 2007175 | 5/1979 | |
| JP | 62-43392 A * | 2/1987 | ..... 416/223 R |
| WO | WO-93/01972 A1 * | 2/1993 | ..... 416/223 R |
| WO | WO-93/24360 A1 * | 12/1993 | ..... 416/142 |

* cited by examiner

*Primary Examiner*—Christopher Verdier
(74) *Attorney, Agent, or Firm*—Kilpatrick Stockton LLP

(57) ABSTRACT

A foldable propeller for a ship having a hub (2) for mounting on a drive shaft of the ship, and at least two skew-type blades (1), each of which is pivotably arranged in the hub (2) for configuration between a first, essentially folded together position and a second, essentially unfolded position, wherein each blade (1) presents a generator line (8). Each of the blades (1) has a skew distribution such that the leading edge of the inner and outer radii, respectively, are located substantially forward and aft of the generator line (8) of the blade (1). The mid-chord line (10) of the propeller extends substantially forward and aft of the generator line (8) of the blade (1). A foldable propeller with such blade geometry provides improved performance; in particular, ready unfolding, high reverse thrust and low noise and vibration.

53 Claims, 7 Drawing Sheets

FOLDABLE PROPELLER

RELATED PATENT APPLICATIONS

This is a continuation application of U.S. application Ser. No. 09/085,800 filed May 27, 1998, now abandoned, which is a continuation application of International Application Number PCT/SE96/01552 filed Nov. 27, 1996 which claims priority to Swedish Application Number SE9504253-7 filed Nov. 28, 1995. The disclosure of U.S. application Ser. No. 09/085,800 is hereby expressly incorporated by reference.

FIELD OF THE INVENTION

The present invention relates to a foldable propeller for a boat, ship or other water vehicle.

BACKGROUND OF THE INVENTION

In the field of sailing-boats, the use of so-called foldable propellers is previously known. Normally, such a propeller is adapted to be used with a propulsion engine for propelling the boat forwardly or rearwardly.

A propeller imposes a certain drag force on the sailing-boat when the propeller is not used. For this reason, the propeller can be made foldable, i.e. the blades of the propeller are pivotably arranged on a hub so that they fold together (as a result of the movement of the boat in the water) in the direction of the propeller's drive shaft, to a position in which they extend generally in the longitudinal direction of the boat. When the propeller is to be used, the blades are unfolded by means of the rotating action of the drive shaft. The propeller blades are normally designed so as to form a streamlined body in the folded-together state, thereby reducing the drag force.

A number of foldable propellers are previously known. For example, WO 93/01972 shows a propeller which comprises at least three blades which are pivotably mounted between an unfolded position and a folded-together position.

A problem which is significant for the previously known foldable propellers is that they either impose significant drag during sailing or do not deliver the required thrust in forward or reverse operation. Propellers having blades that fold together usually give a low drag force due to their streamlined bodies. However, in forward and particularly in reverse operation, the known folding type of propeller has relatively poor propulsive performance.

A particular problem regarding previously known folding propellers concerns the propulsion during reverse operation. High reverse thrust at bollard or near bollard pull condition (i.e. when the propeller operates at a boat speed which is zero or close to zero) is usually achieved by adding weight to the tip of the blade, thus increasing the centrifugal moment about the blade's pivot axis. In this manner, the opening angle of the blade is increased. However, increasing the weight at the tip of the blades either involves a problem in the form of thick blade sections with poor cavitation properties or in the form of long sections which tend to reduce the propeller efficiency in forward operation of the propeller.

Another problem which is common not only to sailing-boat propellers, but to any propeller operating in a non-uniform velocity field, is the noise and vibrations induced by the propeller. The propeller generates pressure pulses which force the boat's hull or superstructure to vibrate fiercely and thus to generate unwanted noise. In applications where the propeller's drive shaft is connected to a high power propulsion means, the risk for high noise levels is significant for previously known folding propellers, since their blades are usually too narrow and blunt in order to avoid cavitation, which is not only a cause of thrust breakdown, but also a major source of noise and vibration.

In known designs, several methods for reducing noise and vibrations exist; for example, increasing the number of blades. A propeller with many blades generates less fluctuating propeller forces than a propeller with fewer blades since the propeller hub acts as an integrator, i.e. the load on individual blades is superimposed by the hub and transferred via the propeller shaft to the hull of the boat.

Noise and vibrations can also be reduced by reducing the pitch at either the blade's tip or its root, or both. This reduces the blade loading locally and thereby reduces the strength of the tip and hub vortices, which usually induce substantial pressure pulses on the hull.

Moreover, noise and vibrations can generally be reduced by avoiding cavitation or by arranging the propeller with skewed blades. Cavitation is normally avoided by giving the propeller a sufficiently large blade area. Injection of air into vapor cavities is also an effective method for eliminating their erosive behavior and the generation of high frequency noise.

A particular problem related to foldable propellers is possible thrust reduction due to cavitation at high drive shaft power. In known designs, this problem is solved by giving the propeller a sufficiently large blade area, which is accomplished by using long blade sections and/or a large number of blades. However, the blade area cannot be made too large, since this decreases the propeller efficiency and also complicates the folding of the blades.

A general problem related to propellers is to obtain a high forward thrust or propeller efficiency at any speed. The general solution to this problem is a large propeller diameter in combination with a low drive shaft speed. In addition, the radial load distribution of the propeller should be optimum and the blade area should be made large enough in order to avoid cavitation. Furthermore, the blades should have thin cambered sections of the airfoil type.

Another problem which relates to foldable propellers concerns the folding function. Previously known folding propellers having high pitch-diameter ratio may have poor opening characteristics. The reason for this is that the blades of the propeller "shadow" each other, i.e. they cover each other more or less completely in the folded-together state. The hydrodynamic moment about the blade's pivot becomes negative and so large in magnitude when the blades are fully folded that the positive centrifugal moment never becomes large enough to start the opening of the propeller. The known solution to this "shadowing" problem is to tilt the blade sideways. However, a major drawback of tilting the blades is that they do not fold as well. This generates a higher drag force during sailing.

A particular requirement relating to foldable propellers is that they should present low drag during sailing. This is generally achieved by giving the propellers a streamlined shape in the folded-together position. The usual low-drag solution is a propeller with a hub of small diameter and two straight narrow blades that fold with the flow during forward motion of the boat. A foldable propeller of this kind is previously known from GB 1416616.

Another problem relating to folding propellers is that the folding mechanism malfunctions on occasion, possibly causing both personal injury and material damage.

In view of the above described deficiencies associated with the designs and implementations of known designs for foldable propellers, the present invention has been developed to alleviate these drawbacks and provide further benefits to the user. These enhancements and benefits are described in greater detail hereinbelow.

SUMMARY OF THE INVENTION

The present invention in its several disclosed embodiments alleviates the drawbacks described above with respect to conventionally designed foldable propellers and incorporates several additionally beneficial features.

One object of the present invention is to provide a foldable propeller which solves the above-mentioned problems, in particular the problems regarding high reverse thrust of the propeller and low noise and vibrations. This object is accomplished by configuring a foldable propeller according to the teachings of the present invention, the features of which will be defined in greater detail hereinbelow.

According to a preferred embodiment of the present invention, the propeller presents highly skewed blades, i.e. the blades have a generally curved shape where the leading edge of the inner and outer radii are respectively located substantially aft and forward of the blade's generator line.

Preferably, the propeller presents a developed blade-area ratio which is greater than approximately 35%; at least in the case where three blades are used. Consequently, the developed blade-area can be said to be greater than approximately 10% "per blade". This gives a very effective and reliable folding function, low noise and vibration levels, less cavitation at high shaft power and a reduced moment about the blade's generator line. The term "developed" blade-area can be defined as the area presented by one surface of a blade if it is "flattened out", i.e. the pitch angle for the blade is zero for each blade section and the resulting area is measured.

The design of a propeller is always a process of finding the best compromise to a set of requirements. In this process, some requirements are given more importance than others. For most previously known propellers, high efficiency in forward operation and cavitation avoidance are the two requirements which are given the highest priority. This is also the case for previously known sailing-boat propellers.

However, the operational characteristics of the foldable propeller of the present invention have been given a completely different order of priority, or weighting. Here, high weight has been given to responsive unfolding and high reverse thrust at bollard or near bollard pull condition. Next, weight has been given to low noise and vibration. Subsequently, weights has been given to cavitation avoidance and high forward thrust. Consequently, the folded propeller of the present invention is designed to provide, in particular, streamlined, low-drag sailing characteristics, responsive unfolding from the streamlined nested or folded configuration, high reverse thrust at bollard or near bollard pull condition and low noise and vibration levels on board.

Noise and vibrations can normally be avoided by using skewed blades which, contrary to conventional straight blades, gradually enter regions with disturbed flow and therefore generate a smoother blade loading history, by means of which a decrease in the amplitude of the load on the blade is achieved. However, in the prior art, no foldable propeller having a substantial skew exists. This is due to the fact that, according to the previously known technology, a skewed propeller is difficult to fold.

It should be noted that in common usage the terms "boat" and "ship" are normally intended to cover different types of vessels, however, in the present application each should be considered interchangeable for purposes of the claims. Each is also considered to include small boats as well as large ships, or any other vehicle for use in or on water. Furthermore, the invention can be used on boats with or without sails.

The beneficial effects described above apply generally to the exemplary constructions and implementations disclosed herein for a skew-bladed foldable propeller. The specific structures through which these benefits are delivered will be described in detail hereinbelow.

DESCRIPTION OF THE PREFERRED EMBODIMENT(S)

Figure 1:
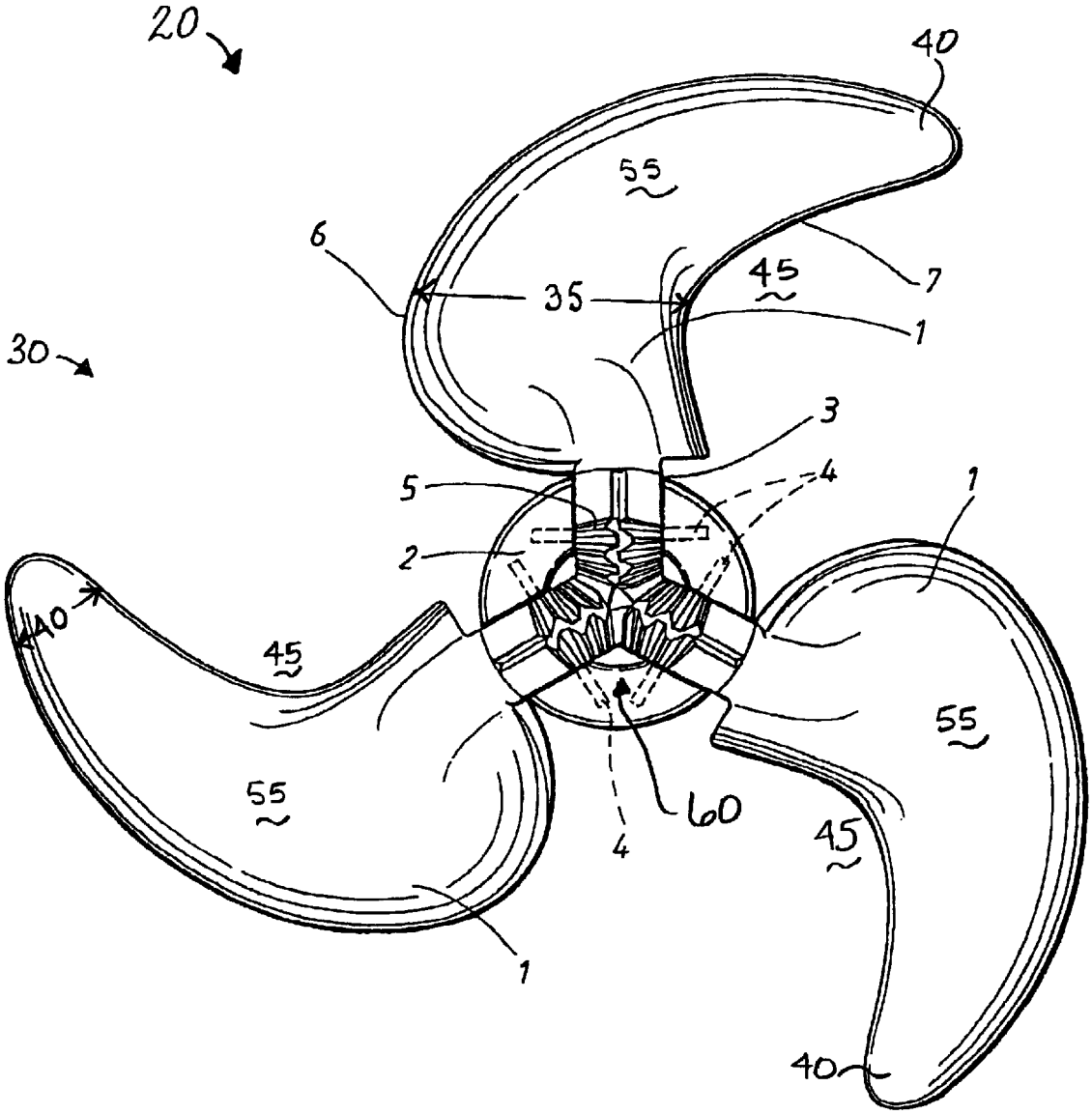
FIG. 1 shows an end view of a foldable propeller according to the present invention.
Figure 9:
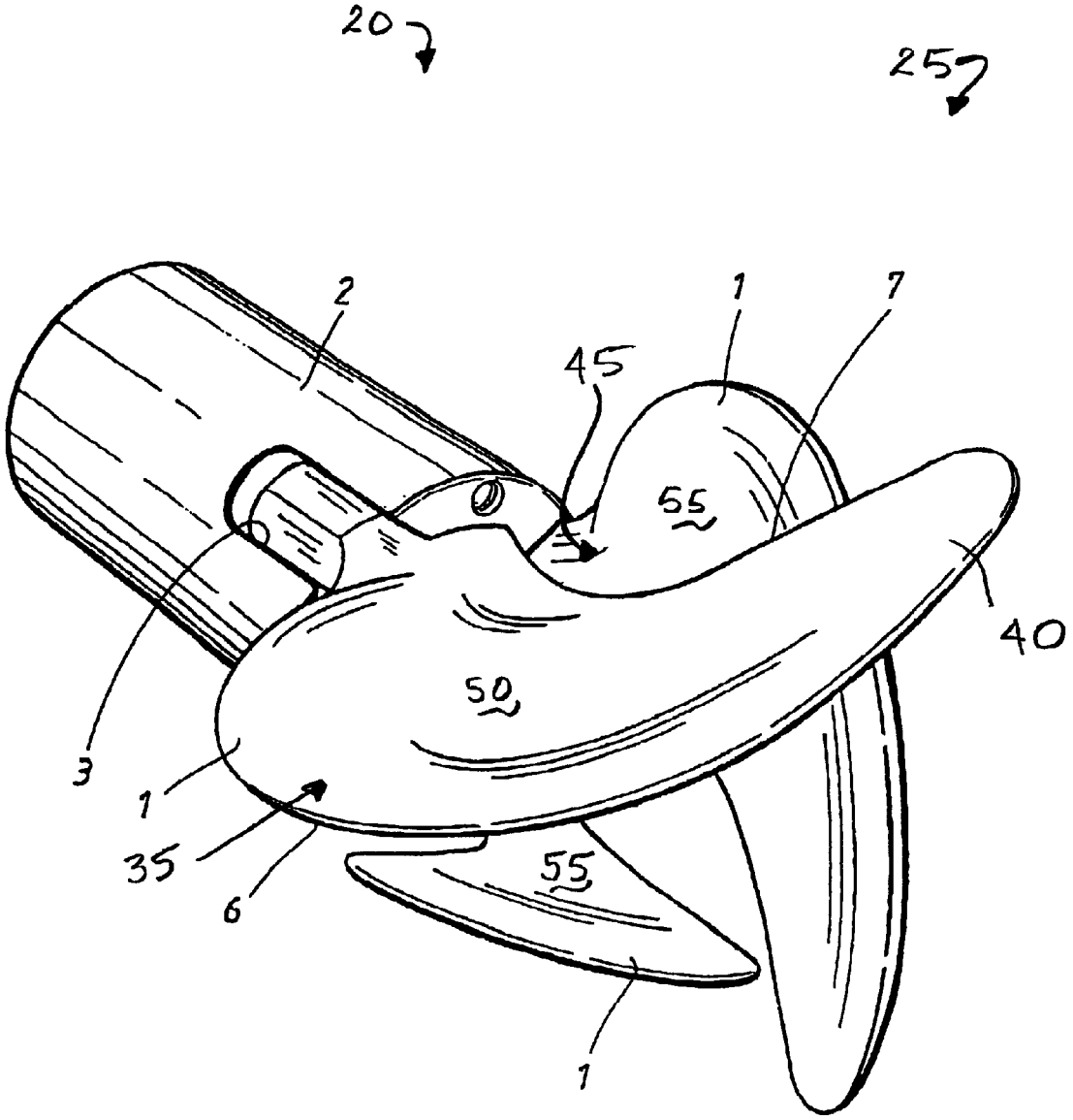
FIG. 9 is shows the propeller according to the invention in a folded-together position.

As required, detailed embodiments of the present invention are disclosed herein; however, it is to be understood that the disclosed embodiments are merely exemplary of the invention that may be embodied in various and alternative forms; the illustrations, do, however, disclose a preferred embodiment. In that regard, FIGS. 1–3 and 9 collectively illustrate primary structural, cooperative and performance aspects of the invention. That is to say, a foldable propeller arrangement 20 for a marine vehicle is shown through out those figures. The arrangement 20 includes a plurality of skew blades 1, each of which is arranged to transition between folded 25 and unfolded configurations 30. Each of the skew blades 1 has a broad body portion 35, a narrowed tip portion 40, a convex leading edge 6, and a concave trailing edge 7. These features of the skew blades 1 may be best appreciated in FIG. 1. The concave trailing edge 7 defines a nesting space 45 for an adjacent skew blade 1 when the foldable propeller arrangement 20 is in the folded configuration 25. This feature of the skew blades 1 may be best appreciated when FIGS. 1 and 9 are taken together. Each of the skew blades 1 has two primary surfaces: an exterior surface 50 that is outwardly directed in the folded configuration 25 and that is substantially forward facing in the unfolded configuration 30 and an interior surface 55 that is inwardly directed in the folded configuration 25 and that is substantially backward facing in the unfolded configuration 30.

As may be best appreciated in FIG. 9, the narrowed tip portion 40 of a skew blade 1 extends exteriorly of the exterior surface 50 of the adjacent skew blade that is received within the nesting space 45 of that skew blade thereby facilitating unfolding of the foldable propeller arrangement 20 during initiation of reverse thrust rotation, i.e., clockwise rotation of the foldable propeller arrangement 20 in FIG. 9. As shown, the narrowed tip portion 40 of each of the skew blades 1 extends transversely to the exterior surface 50 of the adjacent skew blade nested therein. Preferably, and as shown in FIG. 9, the arrangement 20 orients the narrowed tip portion 40 substantially perpendicularly to the exterior surface 50 of the adjacent skew blade nested therein in the folded configuration 25. Still further, each of the exterior surfaces 50 and each of the interior surfaces 55 of the plurality of skew blades 1 are oriented substantially parallel with a rotational axis of the foldable propeller arrangement 20 in the folded configuration 25.

Figure 2:
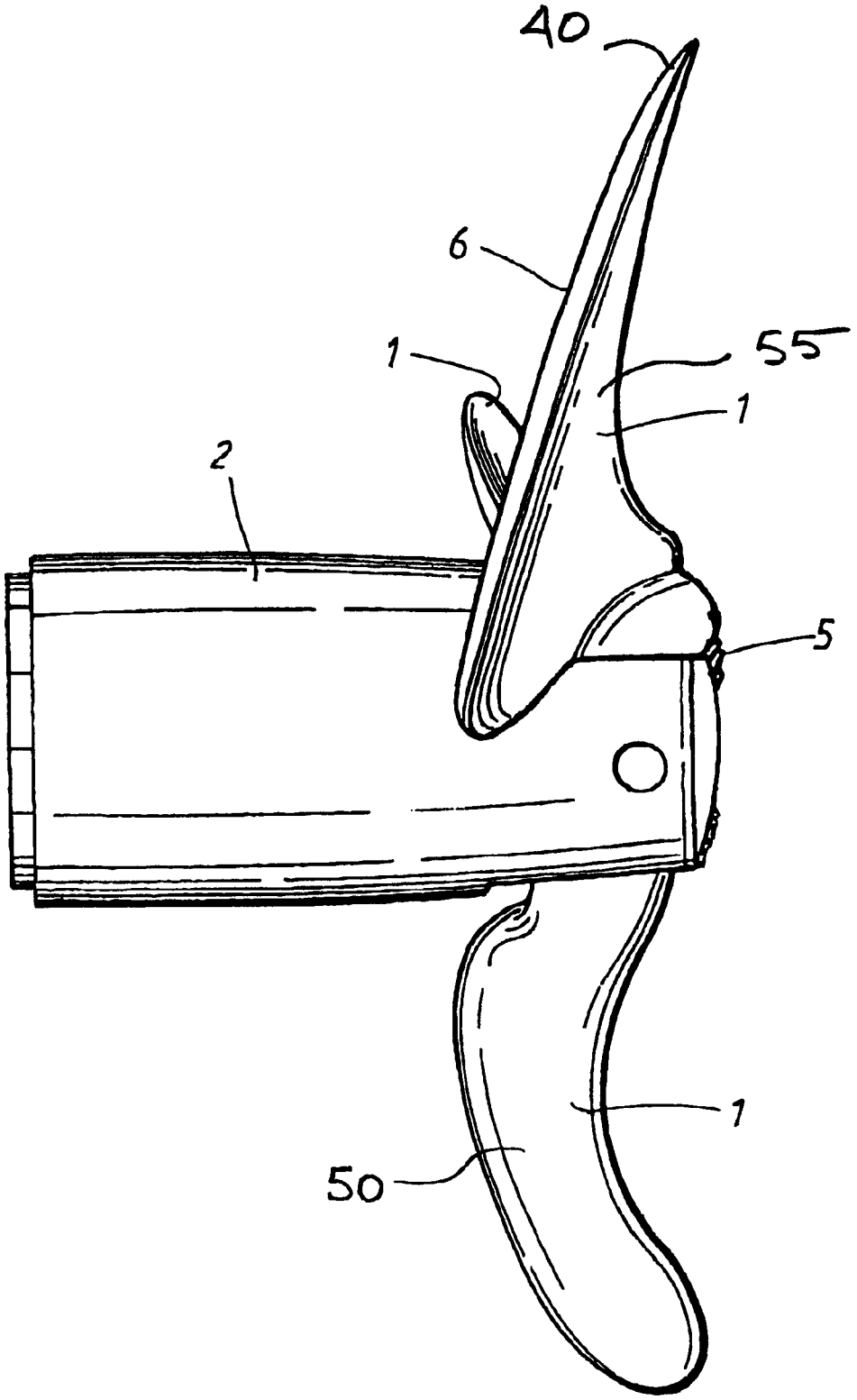
FIG. 2 shows a side view of the propeller of FIG. 1.

As may best be appreciated from FIG. 2, the skewed configuration of each of the skew blades 1 develops a positive pressure on the interior surface 55 during initiation of reverse thrust rotation thereby urging each respective skew blade toward the unfolded configuration 30. Similarly, the skewed configuration develops a negative pressure on the exterior surface 50 during initiation of reverse thrust rotation thereby urging each respective skew blade toward the unfolded configuration 30.

Figure 5:
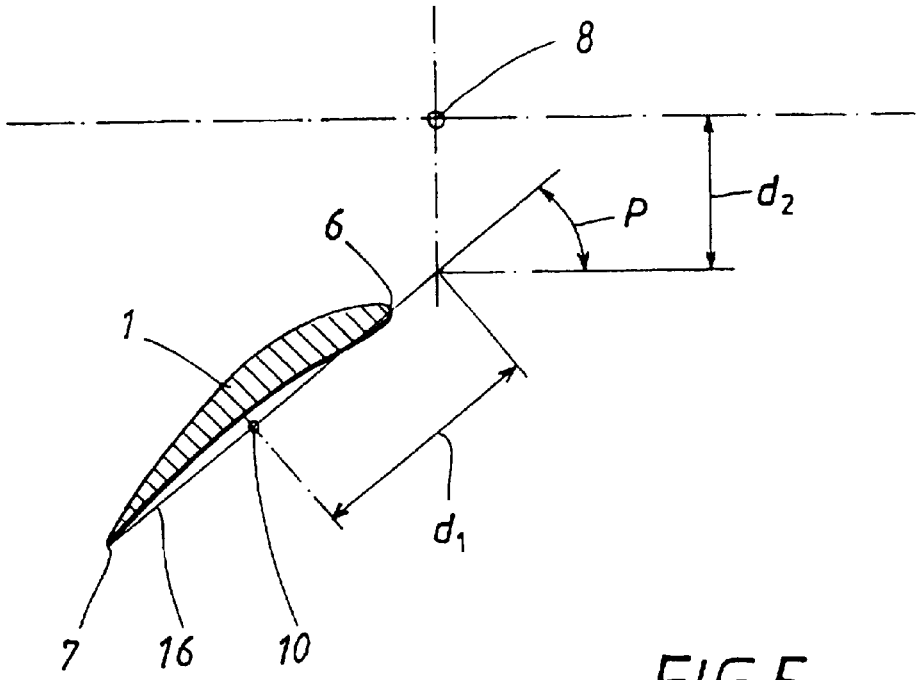
FIG. 5 is a diagram illustrating the notation for describing the blade geometry.

As may be best appreciated from FIG. 5, a predominance of the mass or weight of each of the skew blades 1 is concentrated toward the convex leading edge 6 of each of the skew blades thereby enhancing the centrifugal unfolding tendencies of the foldable propeller arrangement 20 during reverse thrust rotation because in this configuration, the predominance of the weight of the skew blades 1 of the foldable propeller arrangement 20 is located substantially at an outer periphery of the foldable propeller arrangement 20 in the unfolded configuration 30.

Figure 4:
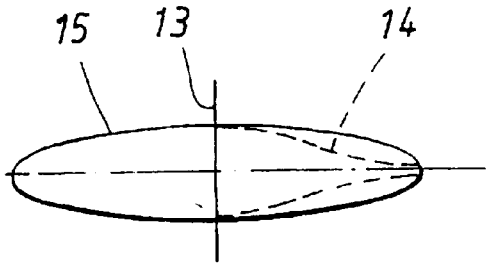
FIG. 4 is a diagram illustrating the thickness distribution of the propeller according to the invention.

FIG. 4 demonstrates that each of the skew blades 1 has a substantially elliptical cross-sectional shape 15 and thereby avoids cavitation.

FIG. 1 shows that each of three skew blades 1 is pivotally coupled to a hub 2 and that each of the skew blades 1 is interconnected with the two adjacent skew blades 1 via a beveled gear arrangement 60 thereby assuring synchronized unfolding of all of the plurality of skew blades 1.

The blades 1 are pivotably mounted in a hub 2 which is intended to be arranged on a drive shaft (not shown) of a boat engine of conventional type. Each blade 1 is manufactured from a relatively heavy material, for example bronze, aluminum bronze (comprising 8–10% aluminum) or steel. The hub 2 may be manufactured from a similar material or a fibre plastic composite. Each blade 1 is arranged in a recess 3 in the hub 2. The pivoting movement of the blades 1 is provided by the fact that the hub 2 presents three shafts 4 which extend through cooperating holes in the blades 1.

A pivoting mechanism of each blade 1 comprises two bevel gear segments 5 per blade, i.e. the innermost end of each blade has a left and right gear segment, which segments are adapted to engage complementary gears on the adjacent blades 1 in all pivoted positions. Thus, the bevel gears 5 cooperate so that the blades 1 may fold together simultaneously.

For each blade 1, a leading edge 6 and a trailing edge 7 for forwards operation of the propeller, i.e. for counter-clockwise rotation as seen in FIG. 1, can be defined. During reverse operation, the leading edge 6 may be considered to act as a "trailing edge" and the trailing edge 7 acts as a "leading edge;" but such changing between conventions will not be utilized in this description in order to maintain consistency and clarity with respect to the drawings. It should be noted that the propeller according to the invention can be designed also for clockwise rotation when operating in the forwards direction.

Figure 3:
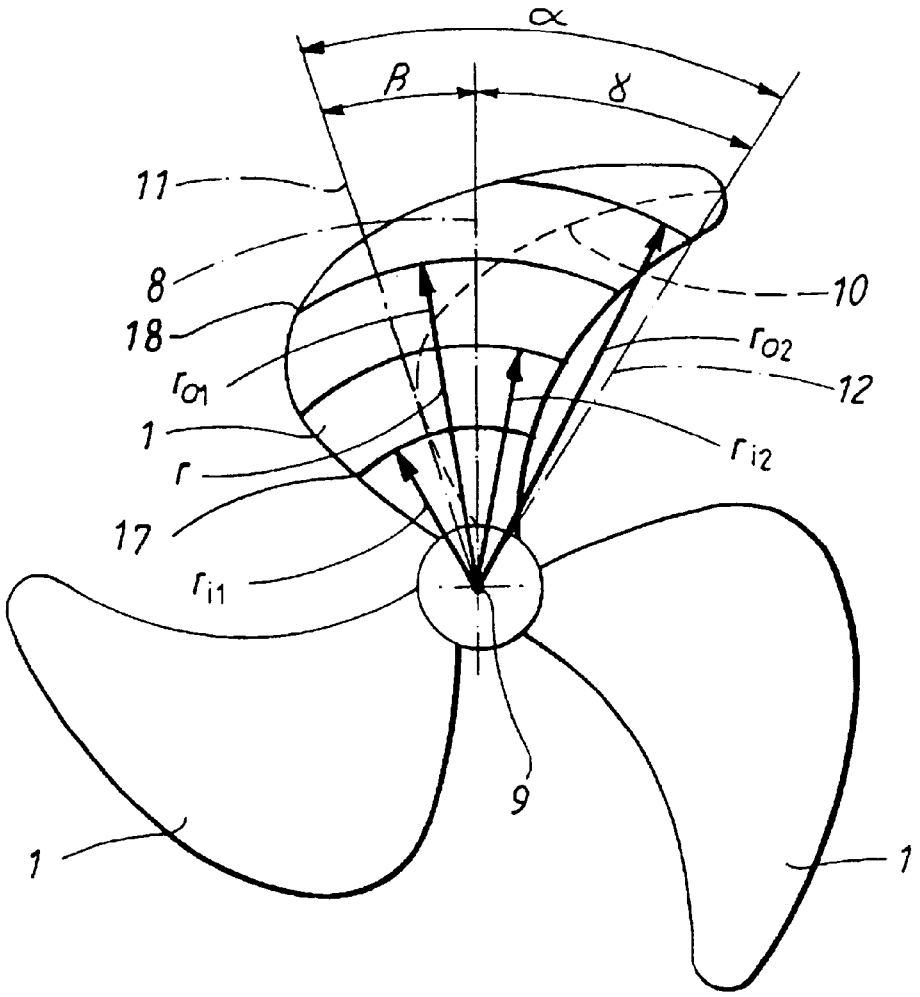
FIG. 3 shows a simplified view of the propeller according to the invention, defining the skew of the propeller.

FIG. 3 shows, in a simplified form, the propeller according to the invention. As is apparent in FIG. 3, the blades 1 are highly skewed, i.e. they extend along a curved line. In order to define the amount of skew of each blade 1, it is necessary to define the so-called generator line 8 of the propeller. The generator line 8 is perpendicular to the longitudinal extension of the propeller axis 9. Furthermore, the generator line 8 extends through the center of the propeller axis 9. Finally, the generator line 8 is perpendicular to the pivot axis about which the blade 1 can be folded.

Furthermore, each blade 1 can also be said to present a mid-chord line 10, which is a line made up of a locus of points equidistant from the trailing and leading edges of the blade.

An important feature of the invention is that each blade 1 has a skew distribution such that the leading edge of the inner and outer radii, respectively, are located forward and aft of the blade's generator line 8.

The skew distribution can be determined by defining the skew angle $\alpha$, which is the sum of a first angle $\beta$ and a second angle $\gamma$. The first angle $\beta$ is the angle between the generator line 8 and a straight line 11 extending perpendicularly from the center 9 of the hub and through the leading edge 1 of the mid-chord line 10. The second angle $\gamma$ is the angle between the generator line 8 and a straight line 12 extending perpendicularly from the center 9 of the hub and through the end point of the mid-chord line 10, at the tip of the blade 1.

The skew angle $\alpha$, i.e. the sum of the first angle $\beta$ and the second angle $\gamma$, is preferably between 30° and 65°, the most preferable interval being between 45° and 55°. The first angle $\beta$ is preferably between 10° and 25°, the most preferable interval being between 15° and 20°, whereas the second angle $\gamma$ is preferably between 20° and 40°, the most preferable being between 30° and 35°.

FIG. 3 also illustrates the inner and outer radii, respectively, which can be defined for a particular blade 1. The inner radii $r_{i1}$ and $r_{i2}$ are examples of radii which extend from the propeller axis 9 to points along the blade 1 which are located inside of the point where the mid-chord line 10 intersects the generator line 8. In a corresponding way, the outer radii $r_{o1}$ and $r_{o2}$ extend from the propeller axis 9 to points along the blade which are located outside of the point where the mid-chord line 10 intersects the generator line 8. The inner radius $r_{i1}$, for example, has a leading edge 17 (for rotation in the counter-clockwise direction) and the outer radius $r_{o1}$, for example, has a leading edge 18 (for counter-clockwise rotation). Each blade 1 has a skew distribution such that the leading edges of the inner and outer radii along the blade are located substantially forward and aft of the generator line 8.

The highly skewed blades 1 according to the invention also present a developed blade-area ratio. The blade-area ratio can be defined as the developed area of the blades divided by the total area within the circle defined by the tips of the blades. The blade-area ratio is preferably higher than 35%, preferably between 35% and 45%. It should be noted that these values apply to the case where the propeller comprises three blades. Consequently, this means that the developed blade-area ratio "per blade" should be higher than approximately 10%.

FIG. 4 illustrates the thickness distribution of a blade. According to the invention, any cross-section along a blade has an essentially symmetrical thickness distribution, i.e. the thickness distribution is symmetrical about a plane 13 defined by the mid-chord line (see also FIG. 3). This means that the difference between the lift-drag ratio in forward operation and the lift-drag ratio in reverse operation is less than for propellers having conventional blade sections. The thickness distribution is illustrated by means of the curve 15 in FIG. 4, in which the leading edge of the blade is the leftmost edge, whereas the trailing edge is the rightmost edge. It is particularly advantageous if the thickness distribution has an essentially elliptical shape.

Regarding FIG. 4, it should be noted that the ellipse 15 illustrates neither the curvature nor the pitch of the blade, but merely illustrates the blade's thickness distribution.

As a reference, FIG. 4 also shows, by means of the broken lines 14, a conventional wing section which presents a non-symmetrical thickness distribution.

Provided that the thickness-chord ratio (i.e. the relationship between the maximum thickness of a blade section and its length, the latter being equal to the distance between the leading edge and the trailing edge) is small, the penalty in lift-drag ratio of using elliptical sections instead of sections with a pointed trailing edge is negligible. Furthermore, in reverse operation the cavitation characteristics of a section with elliptical thickness distribution is superior to sections with a pointed trailing edge. Finally, the solidity of an elliptical section area is significantly higher than for sections with a pointed trailing edge, i.e. the section area for the same thickness-chord ratio is higher. Thus, a blade with elliptical sections can be given higher weight, as well as centrifugal moment about the pivot without sacrificing its lift-drag ratio or cavitation characteristics.

FIG. 5 is a diagram which illustrates the notation for describing the blade's geometry. The generator line 8 extends in a direction normal to the plane of FIG. 5, i.e. towards the viewer. A section of a blade 1 is shown, with its leading edge 6 and trailing edge 7. The mid-chord line 10 is a line which bends in space so that it passes through the mid-chord point of each blade section 1. The skew of a particular blade section can be defined as a distance $d_1$ from the mid-chord line 10 to a plane perpendicular to the generator line 8. Furthermore, the rake of the blade section 1 can be defined as the axial displacement $d_2$ in a plane which is defined by the propeller axis 9 and the generator line 8. In the case shown in FIG. 5, the rake is positive in the direction towards the aft of the propeller and zero when the chord line 16 of the blade section extends through the generator line 8. In this regard, the chord line 16 can be defined as a helix line extending through the leading edge 6 and the trailing edge 7 of the blade section 1. Finally, the pitch angle of the blade 1 can be defined as an angle P formed between the chord-line 16 of the blade section 1 and the projection of the propeller axis in the cross section in question.

Figure 6:
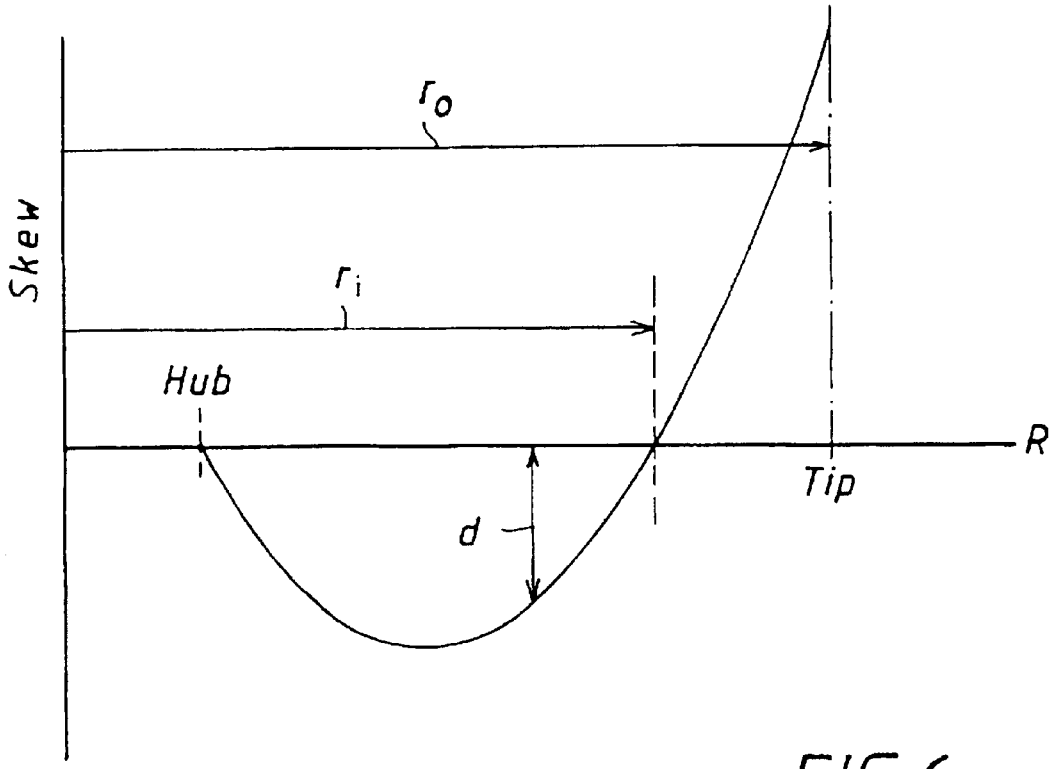
FIG. 6 is a diagram illustrating the skew distribution of the propeller.

FIG. 6 illustrates the skew distribution of the propeller according to the invention. The distance $d_1$ as illustrated in FIG. 5 varies along the radius of the propeller, from a value which is close to zero in the propeller's hub, through a negative value along the mid portion of the propeller and to a positive value in the tip portion of the propeller.

Furthermore, FIG. 6 illustrates that the inner radii of a blade are the radii which are in the interval $r_1$ from zero to the value where the mid-chord line intersects the generator line. Consequently, the outer radii of a blade are the radii which are in the interval $r_o$ which runs from the point where the mid-chord line intersects the generator line to the maximum radius of the blade.

Figure 7:
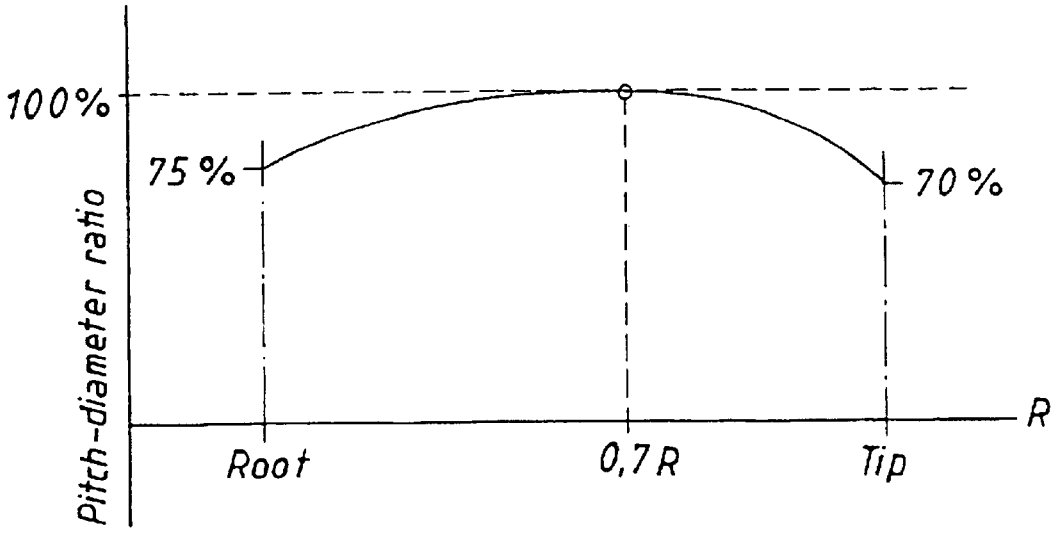
FIG. 7 is a diagram illustrating the pitch distribution of the propeller.

FIG. 7 is a diagram illustrating the pitch of the propeller's blades. In particular, the diagram shows a curve illustrating the pitch-diameter ratio along the radius R of the blade. As is apparent, the pitch of the blade is reduced at the blade's root and tip. The pitch-diameter ratio is reduced to approximately 75% of the pitch-diameter ratio at the point corresponding to 0.7 R, i.e. a point at 70% of the blade's diameter (at which point the pitch-diameter ratio is 100%), and is reduced to approximately 70% at the tip of the blade. In this manner, a reduced strength of tip and hub vortices is obtained, which delays inception of cavitation and reduces induced pressure pulses. Thus, the noise and vibration characteristics of the propeller are greatly improved.

Figure 8:
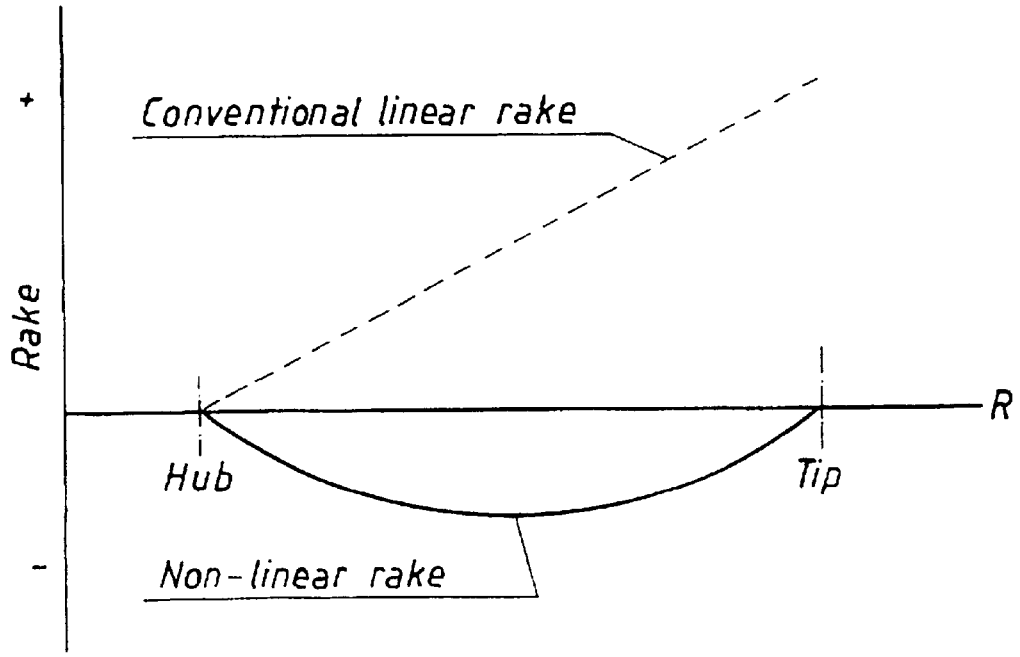
FIG. 8 is a diagram illustrating the rake of a blade of the propeller.

Furthermore, as is illustrated in FIG. 8, the rake distribution (shown by the solid line) of the propeller's blades is negative and non-linear. More specifically, the rake distribution is preferably curved. The fact that the rake distribution is negative means that the shape of the blade is slightly curved and extends forwards. In contrast to this, a conventional rake distribution is normally positive (shown by the dashed line in FIG. 8), whereby the propeller blades extend towards the aft. The advantages with the rake distribution according to the invention are an increased strength of highly skewed blades, and that cavitation at the tip of the blade (if this cannot be avoided) is stabilized and therefore less erosive and noisy.

The propeller according to the invention is designed so that the blades of the propeller can be folded together in an effective and reliable manner. FIG. 9 shows the propeller in its folded-together position. The blades can be folded so that the generator line is substantially parallel to the propeller axis. In this manner, the propeller forms a streamlined body in its folded-together position.

Figure 10:
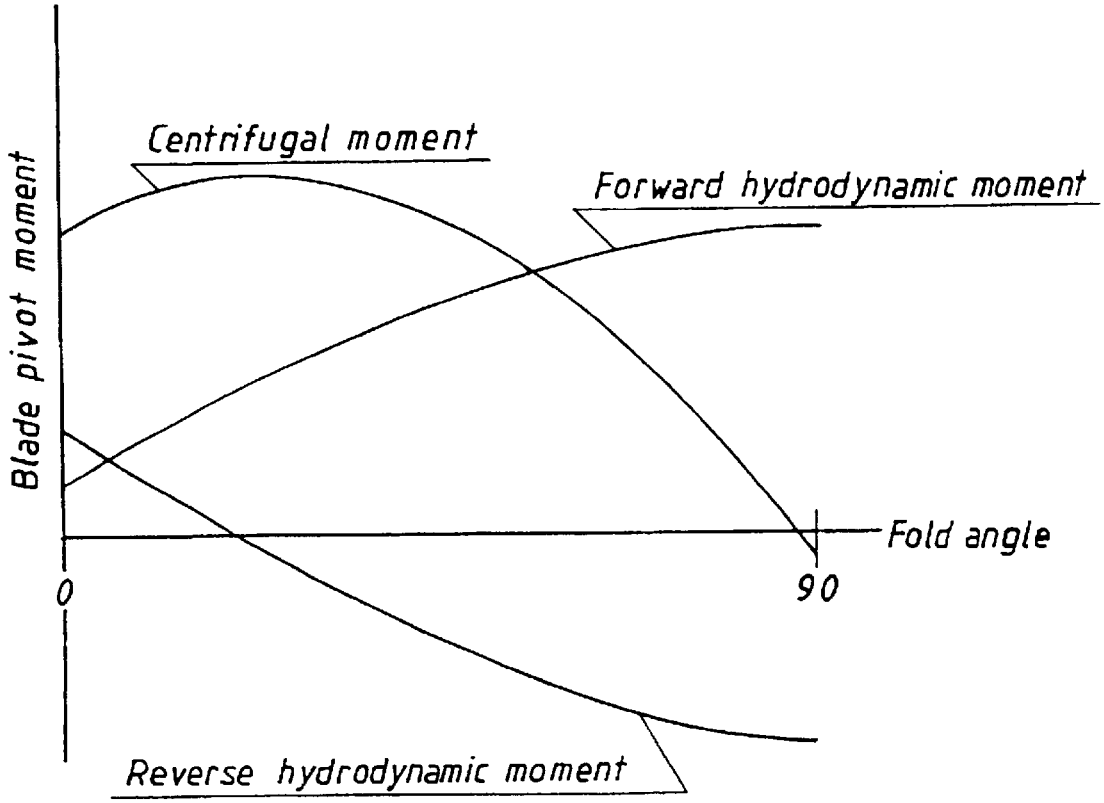
FIG. 10 is a diagram illustrating the pivot moments of a blade.

In the following, the fold principle of the blades will be described. The sign of each blade's centrifugal moment about its pivot axis is independent of the direction of rotation of the propeller, since centrifugal moments are proportional to the square of the shaft speed. However, the centrifugal moment is strongly dependent on the fold angle of the blade. In this regard, the fold angle can be defined as the angle that each blade forms with the longitudinal extension of the hub. For a given shaft speed, the centrifugal moment during the opening process typically varies as shown in FIG. 10. The centrifugal moment is positive when the blades are fully folded, whereas it is close to zero when the propeller is fully opened.

In the initial opening phase, and in reverse operation, the tip region of the blade is, due to the special blade skew, subject to a high angle of attack as well as a high resulting relative velocity. Thus, the lift force is high at the tip of the blade. Consequently, its contribution to the hydrodynamic pivot moment is large and positive. On the other hand, the blade sections of the inner radii are subject to a small angle of attack and a low resulting relative velocity, thus their contribution to the hydrodynamic pivot moment is small.

In forward operation, the hydrodynamic pivot moment is also positive in the initial opening phase since the blade skew guarantees that the inner radii generate a large positive contribution to the hydrodynamic pivot moment, while the contribution from the tip is small.

The above taken together, the resulting pivot moment, i.e. the sum of the centrifugal and the hydrodynamic moment, is always large and positive in the initial opening phase for the propeller according to the invention. The invention provides a blade having a geometry with very favorable resulting pivot moment characteristics in the initial opening phase.

Figure 11:
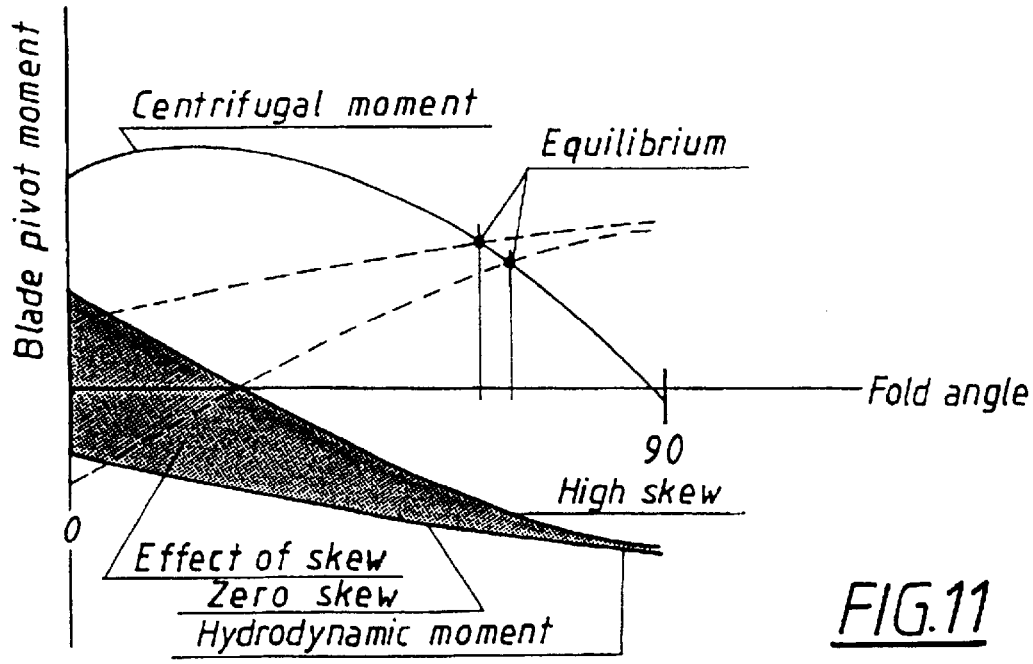
FIG. 11 is a diagram showing the effect of skew on the hydrodynamic pivot moment.

FIG. 11 shows the effect of skew on the hydrodynamic pivot moment. Once the opening process has started, the blade pivots until it either hits the end stop (forward operation) or finds an equilibrium (reverse operation), which occurs when the fold angle is such that the centrifugal pivot moment is equal in magnitude, but opposite in direction to the hydrodynamic moment.

In reverse operation, the blade's hydrodynamic pivot moment with the new skew distribution is less negative than for the corresponding blade with zero skew, as shown in FIG. 11. Consequently, the fold angle of equilibrium of the skewed blade is larger, that is, the propeller opens more, and the reverse thrust becomes significantly higher. Again, the special blade skew distribution is, together with the elliptic blade sections, a major reason for the improved thrust, particularly in the reverse direction, of the propeller according to the invention.

It is to be noted that the blades are so arranged (see also FIGS. 1 and 2) that they can pivot at least to zero degrees in the folded-together position.

The invention is not limited to the above-mentioned embodiments, but may be varied within the scope of the appended claims. For example, the propeller can have two or more blades. However, a three-bladed propeller is easier to balance than a two-bladed propeller, i.e. the balance requirement for each blade can be made less strict for a given maximum propeller unbalance. Thus, the cost for balancing is lower.

Finally, it should be noted that since all the blades 1 are able to be identical, the manufacturing of the blades is greatly simplified. The bevel gears which can be effectively manufactured, provided that an advanced milling machine can be used, provide an advantage, since the blades are thus more difficult to copy.

A foldable propeller and its components have been described herein. These and other variations, which will be appreciated by those skilled in the art, are within the intended scope of this invention as claimed below. As previously stated, detailed embodiments of the present invention are disclosed herein; however, it is to be understood that the disclosed embodiments are merely exemplary of the invention that may be embodied in various forms.

What is claimed and desired to be secured by Letters Patent is as follows:

1. A foldable propeller arrangement for a marine vehicle, said arrangement comprising:

a plurality of skew blades, each of said skew blades arranged to transition between folded and unfolded configurations;

each of said skew blades having: a broad body portion, a narrowed tip portion, a convex leading edge, and a concave trailing edge, said concave trailing edge defining a nesting space for an adjacent skew blade in the folded configuration;

each of said skew blades having two primary surfaces, an exterior surface in the folded configuration that is substantially forward facing in the unfolded configuration and an interior surface in the folded configuration that is substantially backward facing in the unfolded configuration; and said narrowed tip portion of each of said skew blades extending exteriorly of said exterior surface of an adjacent skew blade nested within said nesting space of the respective skew blade thereby facilitating unfolding of the foldable propeller arrangement during initiation of reverse thrust rotation.

2. The arrangement as recited in claim 1 and further comprising:

said narrowed tip portion of each of said skew blades extending transversely to said exterior surface of said adjacent skew blade nested within said nesting space of the respective skew blade in said folded configuration.

3. The arrangement as recited in claim 1 and further comprising:

said narrowed tip portion of each of said skew blades extending substantially perpendicularly to said exterior surface of said adjacent skew blade nested within said nesting space of the respective skew blade in said folded configuration.

4. The arrangement as recited in claim 1 and further comprising:

said skewed configuration of each of said skew blades developing a positive pressure on said interior surface during said initiation of reverse thrust rotation thereby urging each respective skew blade toward the unfolded configuration.

5. The arrangement as recited in claim 1 and further comprising:

said skewed configuration of each of said skew blades developing a negative pressure on said exterior surface during said initiation of reverse thrust rotation thereby urging each respective skew blade toward the unfolded configuration.

6. The arrangement as recited in claim 1 and further comprising:

a predominance of the weight of each of said skew blades is concentrated at said leading edge of said respective skew blade thereby enhancing the centrifugal unfolding tendencies of the foldable propeller arrangement during reverse thrust rotation because in this configuration, said predominance of the weight of said skew blades of the foldable propeller arrangement is located substantially at an outer periphery of the foldable propeller arrangement in the unfolded configuration.

7. The arrangement as recited in claim 1 and further comprising:

each of said skew blades having a substantially elliptical cross-sectional shape thereby avoiding cavitation.

8. The arrangement as recited in claim 1 and further comprising:

each of said skew blades being pivotally coupled to a hub; and each of said skew blades being interconnected with at least one adjacent skew blade via a beveled gear arrangement thereby assuring synchronized unfolding of all of said plurality of skew blades.

9. The arrangement as recited in claim 1 and further comprising:

each of said skew blades being pivotally coupled to a hub, said plurality of skew blades being three in number; and each of said three skew blades being interconnected with both of two adjacent skew blades via a beveled gear arrangement thereby assuring synchronized unfolding of all of said three skew blades.

10. The arrangement as recited in claim 1 and further comprising:

each of said exterior surfaces and each of said interior surfaces of said plurality of skew blades being oriented substantially parallel with a rotational axis of said foldable propeller arrangement in the folded configuration.

11. A foldable propeller for a marine vehicle, said foldable propeller comprising:

a plurality of skew blades, each of said skew blades arranged to transition between folded and unfolded configurations;

each of said skew blades having: a broad body portion, a narrowed tip portion, a convex leading edge, and a concave trailing edge, said concave trailing edge defining a nesting space for an adjacent skew blade in the folded configuration; and each of said skew blades positioned in a folded orientation and located at least partially in said nesting space of an adjacent skew blade.

12. A foldable propeller for a marine vehicle, said foldable propeller comprising:

a plurality of skew blades, each of said skew blades arranged to transition between a substantially folded-together configuration and a substantially unfolded configuration;

each of said skew blades having: a broad body portion, a narrowed tip portion, a convex leading edge, and a concave trailing edge, said concave trailing edge defining a nesting space for an adjacent skew blade in said substantially folded-together configuration;

each of said skew blades positioned in said substantially folded-together configuration and located at least partially in said nesting space of an adjacent skew blade;

each of said skew blades having two primary surfaces, an exterior surface in the substantially folded-together configuration that is substantially forward facing in the substantially unfolded configuration and an interior surface in the substantially folded-together configuration that is substantially backward facing in the substantially unfolded configuration; and said narrowed tip portion of each of said skew blades extending exteriorly of said exterior surface of an adjacent skew blade nested within said nesting space of the respective skew blade thereby facilitating unfolding of the foldable propeller arrangement during initiation of reverse thrust rotation.

13. The foldable propeller as recited in claim 12 and further comprising:

a hub mountable on a drive shaft of a water vehicle;

said plurality of skew blades pivotably arranged on said hub for operation between the substantially folded-together configuration and the substantially unfolded configuration, each of said skew blades having a generator line perpendicularly oriented to a longitudinal propeller axis of said foldable propeller when said foldable propeller arrangement is in the substantially unfolded configuration; and each skew blade of said plurality of skew blades has a skew distribution in the substantially folded-together configuration such that a leading edge of an inner radii of said skew blade is located substantially forward of said skew blade's generator line and a leading edge of an outer radii of said skew blade is located substantially aft of said skew blade's generator line.

14. The foldable propeller as recited in claim 13, wherein said plurality of skew blades comprises at least three skew blades.

15. The foldable propeller as recited in claim 13, wherein each skew blade of said plurality of skew blades has a surface that is substantially parallel to said longitudinal propeller axis when said foldable propeller is in the substantially folded-together configuration.

16. The foldable propeller as recited in claim 13, wherein each skew blade of said plurality of skew blades has a mid-chord line that extends substantially forward and aft of said skew blade's generator line when said foldable propeller is in the substantially folded-together configuration.

17. The foldable propeller as recited in claim 16; said foldable propeller further comprising:

a first angle ($\beta$) formed between said generator line and a radial straight line extending through a leading edge of said mid-chord line, said first angle ($\beta$) having a value between 10° and 25° when said foldable propeller is in the substantially unfolded configuration.

18. The foldable propeller as recited in claim 16; said foldable propeller further comprising:

a second angle ($\gamma$) formed between said generator line and a radial straight line extending through a distal tip end of said mid-chord line, said second angle ($\gamma$) having a value between 20° and 40° when said foldable propeller is in the substantially unfolded configuration.

19. The foldable propeller as recited in claim 18; said foldable propeller further comprising:

a first angle ($\beta$) formed between said generator line and a radial straight line extending through a leading edge of said mid-chord line, said first angle ($\beta$) having a value between 10° and 25° when said foldable propeller is in the substantially unfolded configuration.

20. The foldable propeller as recited in claim 19; said foldable propeller further comprising:

each skew blade of said plurality of skew blades having a skew angle ($\alpha$) defined as a sum of said first angle ($\beta$) and said second angle ($\gamma$), said skew angle ($\alpha$) having a value greater than 25° when said foldable propeller is in the substantially unfolded configuration.

21. The foldable propeller as recited in claim 13, wherein a developed blade-area ratio of each skew blade of said plurality of skew blades is greater than 10%.

22. The foldable propeller as recited in claim 13, wherein said pivotable arrangement of each skew blade of said plurality of skew blades upon said hub permits pivotation of each skew blade to at least zero degrees relative to said longitudinal propeller axis when said foldable propeller is in the substantially folded-together configuration.

23. The foldable propeller as recited in claim 13, wherein each skew blade of said plurality of skew blades has a substantially symmetrical thickness distribution along a radius of said skew blade when said foldable propeller is in the substantially unfolded configuration.

24. The foldable propeller as recited in claim 23, wherein said substantially symmetrical thickness distribution has a substantially elliptical shape.

25. The foldable propeller as recited in claim 13, wherein a pitch at a tip and a root of each skew blade is reduced by at least 10% in relation to a pitch-diameter ratio at 0.7 radius.

26. The foldable propeller as recited in claim 13, wherein a rake distribution of each skew blade is negative and shaped in a substantially circular arc.

27. The foldable propeller as recited in claim 13, wherein an innermost end of each skew blade has at least one gear section adapted to engage complementary gears on at least one adjacent skew blade.

28. The foldable propeller as recited in claim 27, wherein said at least one gear section is a bevel gear.

29. A foldable propeller for a water vehicle, said foldable propeller comprising:

a hub for mounting on a drive shaft of said water vehicle; and at least three skew blades, each of which is pivotably arranged on said hub between a first, essentially folded-together position and a second, essentially unfolded position, wherein each of said skew blades presents a generator line;

each of said skew blades has a leading edge and a skew distribution such that, when said skew blades are in the essentially folded-together position, each of said skew blade's leading edge of an inner and outer radii, respectively, are located substantially forward and aft of a generator line of said skew blade; and a mid-chord line extends substantially forward and aft of said generator line of each of said skew blades, and each of said skew blades defines a surface which is essentially parallel to a longitudinal axis of said drive shaft when each of said skew blades are in said essentially folded-together position.

30. The foldable propeller as recited in claim 29, wherein, a first angle (β), formed between said generator line and a straight line extending through a leading edge of said mid-chord line, has a value between 10° and 25°.

31. The foldable propeller as recited in claim 30, wherein, a second angle (Y), formed between said generator line and a straight line passing through a tip of said mid-chord line, has a value between 20° and 40°.

32. The foldable propeller as recited in claim 31, wherein, a skew angle (α) of each of said skew blades is defined as the sum of said first angle (β, and said second angle (Y), and said skew angle (α) is greater than 25°.

33. The foldable propeller as recited in claim 29, wherein, a developed blade-area ratio of each of said skew blades, is greater than 10% as counted per skew blade.

34. The foldable propeller as recited in claim 29, wherein, each of said skew blades are pivotably arranged for pivoting at least to zero degrees, with reference to said longitudinal axis, in the essentially folded-together position.

35. The foldable propeller as recited in claim 29, wherein, a skew blade section of each of said skew blades has an essentially symmetrical thickness distribution along a radius of each of said skew blades.

36. The foldable propeller as recited in claim 35, wherein, said thickness distribution has an essentially elliptical form.

37. The foldable propeller as recited in claim 29, wherein, a pitch at a tip and a root of each of said skew blades is reduced by at least 10% in relation to a pitch-diameter ratio at 0.7 radius.

38. The foldable propeller as recited in claim 29, wherein, a rake distribution of each of said skew blades is negative and shaped essentially as a circular arc.

39. The foldable propeller as recited in claim 29, wherein, an innermost end of each of said skew blades has at least one gear section adapted to engage complementary gears on adjacent skew blades in all pivoted positions.

40. The foldable propeller as recited in claim 29, wherein, each of said skew blades is provided with at least one bevel gear.

41. The foldable propeller as recited in claim 29, wherein, said skew blades, when not in use, are folded together to form a streamlined body and when in use, said skew blades are substantially unfolded by a rotating action of said drive shaft, wherein the skew blade geometry of each of said skew blades comprises a substantially symmetrical cross-section and a skew distribution along each of said skew blades that encourages an initial opening of said skew blades during said rotating action and further promotes greater opening of said skew blades during reverse operation of said drive shaft resulting in high reverse thrust at a near bollard pull condition with reduced noise and vibration levels.

42. The foldable propeller as recited in claim 41, wherein said skew blade geometry for each of said skew blades further comprises a developed blade-area ratio that enhances tie folding of said skew blades, reduces cavitation at high shaft powers and firther reduces said noise and vibration levels.

43. The foldable propeller as recited in claim 41, wherein said skew blade geometry for each of said skew blades further comprises a negative non-linear rake distribution that increases the strength of said skew blades and stabilizes cavitation, when present, at a tip region of said skew blades.

44. The foldable propeller as recited in claim 43, wherein said skew blade geometry for each of said skew blades further comprises a pitch-diameter ratio distribution that further reduces said noise and vibration levels by delaying inception of cavitation and induced pressure pulses at said tip region and said hub.

45. The foldable propeller as recited in claim 43, wherein said skew distribution varies from a value close to zero at said hub to a negative value along a mid-portion of said skew blades and to a positive value in said tip region.

46. The foldable propeller as recited in claim 41, wherein said substantial symmetrical cross section is a substantially elliptical shape.

47. The foldable propeller as recited in claim 42, wherein said blade-area ratio for each of said skew blades is greater than approximately 10%.

48. The foldable propeller as recited in claim 43, wherein said rake distribution is curved.

49. The foldable propeller as recited in claim 44, wherein said pitch-diameter ratio distribution varies from a maximum value at 0.7 times the radius of one of said skew blades to a minimum value at least 10% less than said maximum value at a root and corresponding tip of each of said skew blades.

50. The foldable propeller as recited in claim 29, wherein an innermost end of each skew blade has at least one gear section adapted to engage complementary gears on at least one adjacent skew blade.

51. The foldable propeller as recited in claim 50, wherein said at least one gear section is a bevel gear.

52. The foldable propeller as recited in claim 29, wherein said skew blades are manufactured from one material selected from the group consisting of steel, bronze, and aluminum bronze comprising 8 to 10 percent aluminum.

53. The foldable propeller as recited in claim 29, wherein said hub is manufactured from one material selected from the group consisting of steel, bronze, fiber plastic composite, and aluminum bronze comprising 8 to 10 percent aluminum.

* * * * *